US007583911B2

(12) United States Patent
Zona et al.

(10) Patent No.: US 7,583,911 B2
(45) Date of Patent: Sep. 1, 2009

(54) CORONA CHARGING DEVICE CLEANING APPARATUS AND METHOD OF CLEANING A CORONA CHARGING DEVICE

(75) Inventors: Michael F. Zona, Holley, NY (US); Richard W. Seyfried, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 95 days.

(21) Appl. No.: 11/676,791

(22) Filed: Feb. 20, 2007

(65) Prior Publication Data

US 2008/0199206 A1 Aug. 21, 2008

(51) Int. Cl.
*G03G 15/02* (2006.01)

(52) U.S. Cl. ..... 399/100

(58) Field of Classification Search ..... 399/100, 399/101, 99, 170, 171, 172
See application file for complete search history.

(56) References Cited

U.S. PATENT DOCUMENTS 3,870,883 A * 3/1975 Oagley ..... 399/100
3,891,846 A * 6/1975 Ito ..... 399/100
4,019,055 A * 4/1977 Derleth ..... 399/100
5,485,255 A * 1/1996 Reuschle et al. ..... 399/168
5,697,019 A * 12/1997 Kim ..... 399/100
7,277,656 B2 * 10/2007 Nakayama ..... 399/100

OTHER PUBLICATIONS

U.S. Appl. No. 11/327,585 filed Jan. 6, 2006 by Zona et al.

* cited by examiner

*Primary Examiner*—Quana M Grainger
(74) *Attorney, Agent, or Firm*—Oliff & Berridge, PLC

(57) ABSTRACT

A corona charging device cleaning apparatus and method of cleaning a corona charging device includes a support member that includes two side surfaces that face in opposite directions. A side shield cleaning member is attached to each side surface to clean an inner surface of a side shield of a corona device. The support member of the corona charging device cleaning apparatus may also include a concavity and a cavity portion. A screen grid cleaning member may be attached to the concavity of the support member to clean a screen grid of the corona charging device. A charging-component cleaning member may be disposed inside the cavity portion of the support member to clean a charging component of the corona charging device.

12 Claims, 4 Drawing Sheets

CORONA CHARGING DEVICE CLEANING APPARATUS AND METHOD OF CLEANING A CORONA CHARGING DEVICE

BACKGROUND

The present disclosure relates to corona charging device cleaning apparatus and methods of cleaning corona charging devices.

Cross-referenced is a co-pending commonly assigned U.S. patent application Ser. No. 11/327,585 filed Jan. 6, 2006 by Michael F. Zona et al. entitled PIN ARRAY SCOROTRON CHARGING SYSTEM FOR SMALL DIAMETER PRINTER PHOTORECEPTORS, the disclosure of which is incorporated herein by reference in its entirety. That application discloses a compact corona charging system for uniformly charging a small radius moving surface. The charging system includes integral independently controllable leading and trailing corona charging sections for sequentially charging a small radius moving surface. The leading corona charging section includes a first elongated corona discharge member transverse to the moving surface and connectable to a first high voltage current supply and a first corona screen grid member connectable to a first screen grid control voltage supply. The trailing corona charging section includes a second elongated corona discharge member transverse to the moving surface and connectable to a second high voltage current supply and a second corona screen grid member connectable to a second screen grid control voltage supply and electrically independent of the first corona screen grid member and the first screen grid control voltage supply. The first corona screen grid member is interposed between the first elongated corona discharge member and the small radius moving surface. The second corona screen grid member is interposed between the second elongated corona discharge member and the small radius moving surface.

Charging photoreceptor drums has been accomplished using contact charging methods. Some methods use bias charging rolls due to their small size and ease of manufacture. Charge roll technology uses high AC voltages for uniform charging that generate reactants on the photoreceptor transport layer which can degrade the transport layer causing physical wearing of the surface. This wearing limits the useable life of the photoreceptor device, which in turn drives up system costs. These costs can be especially high in color systems that may have multiple photoreceptor devices.

Other charging methods implement corona charging systems that include electric corona discharge wires or pin arrays. These systems are known as corotrons or scorotrons (the latter having discharge screen control grids). The systems use corona discharge to generate ions that are directed to the surface of the drums or onto belts that are wrapped around drums.

A corotron usually consists of a thin wire(s) that is stirring within a metal enclosure which is open on one face. The wire is subjected to several thousand volts. The intense electric fields around the wires cause the air molecules to ionize, and thus charged ions, whose polarity depends on that of the high voltage, are driven onto the photoconductor surface. A typical corotron may have multiple individual corona wires placed at a relatively small distance from the photoconductor surface.

A scorotron usually consists of a series of corona wires with a screen or grid composed of larger diameter wires placed between the corona wires and the photoconductor surface. The screen wires are biased to a potential close to that desired at the photoconductor. The photoreceptor charging process ceases when the surface potential reaches the potential of the screen grid bias.

SUMMARY

The demand for more compact corona charging systems has increased as the technology relating to such devices as printers, copiers and fax machines has become more advanced and the devices more sophisticated. A smaller, compact footprint scorotron has been developed, for example, as described in the above-incorporated U.S. patent application Ser. No. 11/327,585. Due to the miniature nature of the developed scorotron, less airflow travels through the charging device as compared to a larger, conventional corotron or scorotron. As a result, toner and/or silica contamination collects on the inner surface of the side shield of the compact scorotron. The build up of contamination causes an insulating layer to be formed on each side shield, which adversely effects the field formation between the pin tip (or wires) and the side shield. That is, the resulting insulating layer reduces the electric field between the pin tip (or wires) and the side shield. The reduction of the electric field reduces the amount of ion generation at the pin tips and causes the photoreceptor voltage to become non-uniform. The non-uniformity yields poor halftone uniformity on document prints.

The present disclosure describes corona charging device cleaning apparatus and methods of cleaning corona charging devices that clean an inner surface of a side shield of a corona charging device to maintain superior electric field formation and maintain good uniformity over the life of the charging device. Exemplary cleaning apparatus and methods clean the side shields to prevent the contaminating insulating layer of toner particles and silica growth from being formed.

In exemplary embodiments, there is provided a corona charging device cleaning apparatus including a support member including two side surfaces that face in opposite directions; and a side shield cleaning member attached to each side surface to clean an inner surface of a side shield of a corona charging device.

In this exemplary embodiment, the side shield cleaning member prevents a contamination layer of toner or silica from forming an insulating layer on the inner surface of the side shields of the corona charging device. As a result, the electric field formation between charging components and a screen grid of the corona charging device is maintained, and the uniformity of the photoreceptor voltage is not adversely effected.

In various exemplary embodiments, a screen grid cleaning member is attached to a surface of a concavity of the support member to additionally clean a screen grid of the corona charging device.

In various exemplary embodiments, a charging-component cleaning member is disposed inside a cavity portion of the support member to additionally clean a charging component of the corona charging device.

In various exemplary embodiments, the corona charging device cleaning apparatus includes a combination of the side shield cleaning member, the screen grid cleaning member, and/or the charging-component cleaning member.

In various exemplary embodiments, the side shield cleaning member includes an abrasive material.

In various exemplary embodiments, the side shield cleaning member includes an abrasive material that is more abrasive than the screen grid cleaning member and more abrasive than the charging-component cleaning member.

In various exemplary embodiments, the side shield cleaning member is at least one of foam, felt, sandpaper, nylon, metal fibers, stiff plastic fibers, a brush.

In various exemplary embodiments, the charging-component cleaning member is comprised of bristles.

In various exemplary embodiments, the side shield cleaning member is replaceably attachable to the support member. In these exemplary embodiments, the side shield cleaning member can be replaced without having to replace the support member.

In various exemplary embodiments, the corona charging device cleaning apparatus may be incorporated in a xerographic device.

In various exemplary embodiments, the xerographic device may include a corona charging device, and an actuator that is operatively connected to the corona charging device cleaning apparatus. The actuator moves the cleaning apparatus substantially along a length of the corona charging device during a cleaning operation.

In various exemplary embodiments, the xerographic device may further include guide means connected to an end portion of the support member to guide an advancement of the cleaning apparatus along the length of the corona charging device.

In various exemplary embodiments, the corona charging device cleaning apparatus is detachably connected to a rod that is manually movable substantially along a length of the corona charging device.

Exemplary embodiments may provide a method of cleaning a corona charging device, the method including providing a side shield cleaning member to clean an inner surface of a side shield of the corona charging device, and moving the side shield cleaning member substantially along a length of the corona charging device to remove particles from the inner surface of the side shield.

In various exemplary embodiments of the method, the side shield cleaning member is abrasive.

In various exemplary embodiments of the method, the side shield cleaning member is at least one of foam, felt, sandpaper, nylon, metal fibers, stiff plastic fibers, a brush.

In exemplary embodiments, there is provided a corolla charging device cleaning apparatus including a support member having two side surfaces that face in opposite directions away from each other, a concavity, and a cavity portion. A side shield cleaning member is attached to the side surfaces to clean an inner surface of a side shield of a corona charging device. A screen grid cleaning member is attached to the concavity of the support member to clean a screen grid of the corona charging device. A charging-component cleaning member is disposed inside the cavity portion of the support member to clean a charging component of the corona charging device.

In these exemplary embodiments, the side shield cleaning member includes an abrasive material.

In these exemplary embodiments, the side shield cleaning member is more abrasive than the screen grid cleaning member and more abrasive than the charging-component cleaning member.

In these exemplary embodiments, the side shield cleaning member is at least one of foam, felt, sandpaper, nylon, metal fibers, stiff plastic fibers, a brush.

The term "image forming device" or "printer" as used herein broadly encompasses various printers, copiers, fax machines, multifunction machines or systems, xerographic or otherwise, unless otherwise defined in a claim.

BRIEF DESCRIPTION OF THE DRAWINGS

Various exemplary embodiments are described in detail, with reference to the following figures, in which.

DETAILED DESCRIPTION OF EMBODIMENTS

Figure 1:
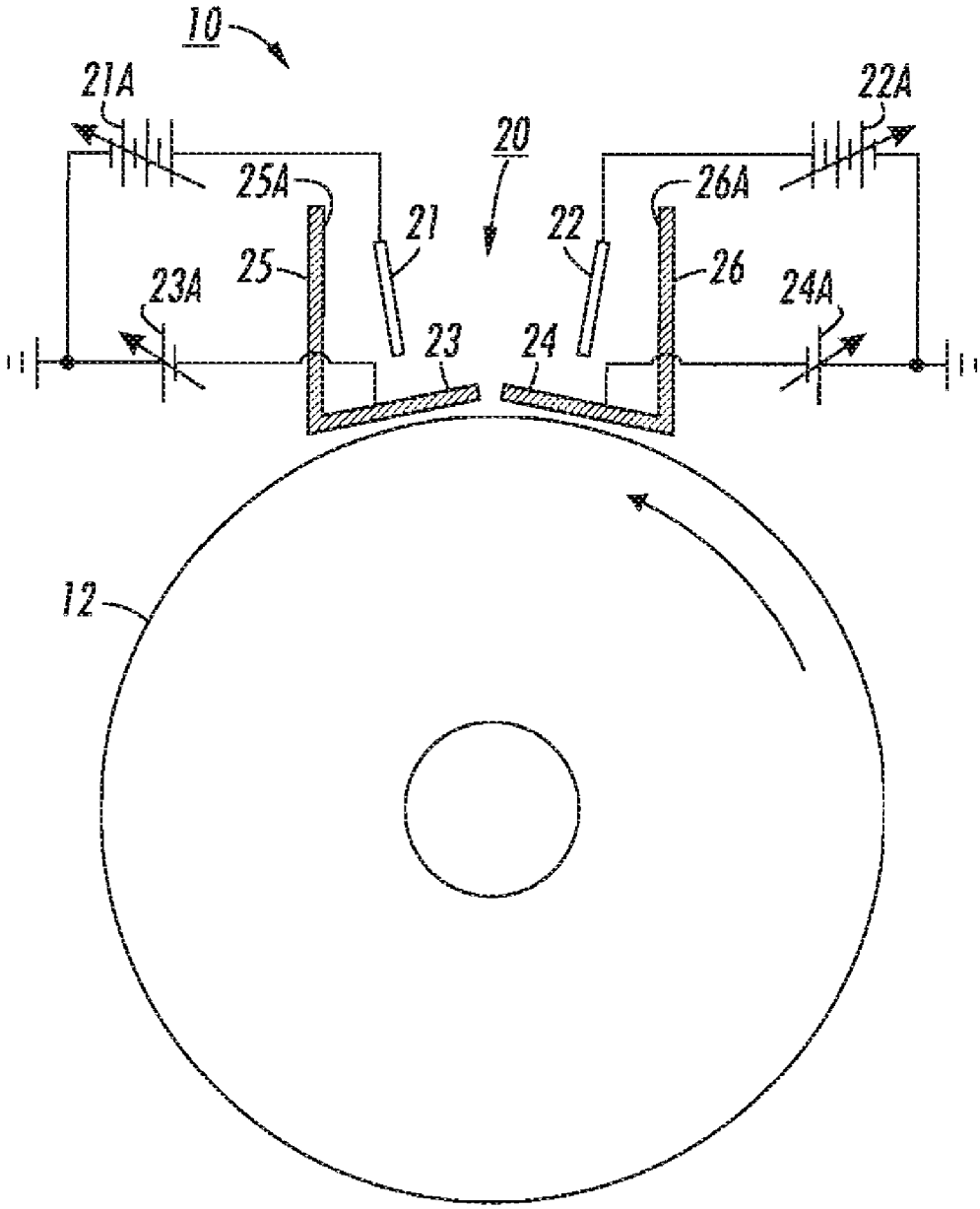
FIG. 1 is a schematic side view of an exemplary compact corona charging device with which the disclosed cleaning apparatus may be used.

FIG. 1 provides a schematic representation of one example of a corona charging device 10 for charging the surface of a small diameter photoreceptor 12 with a compact scorotron 20 which may be substantially conventional other than as described herein. This scorotron 20 has first and second separate pin charging members 21 and 22. The pin charging members 21 and 22 may be differently angled (that is, they are not parallel to each other). The charging members may be comprised of wires instead of pins. Electrical connections to the pin charging members 21 and 22 for their corona generation may be separate, adjustable high voltage DC current supplies 21A and 22A. The generated electrical corona emissions from the tips of the charging members 21 and 22 are respectively controlled by a dual or split screen system of underlying separate screen grids 23 and 24 between the charging members 21 and 22 and the surface 12. The screen grids 23 and 24 may be differently angled. The screen grids 23 and 24 may have separately adjustable control voltage supplies 23A and 24A.

The pin arrays 21 and 22 and two electrically independent grids 23 and 24 provide a suitable non-contact charging system for various small diameter photoreceptor surfaces. For example, in some embodiments, photoreceptor diameter is less than 60 mm. The charging device 20 also is relatively compact. For example, in some embodiments, the charging device 20 may be about 18 mm wide. In some embodiments, the pin arrays 21 and 22 may be spaced as close as 6 mm apart from each other from charging tip end to charging tip end. Each may be angled so that each is approximately perpendicular to a line drawn tangent the surface of the photoreceptor 12. Each of the screen grids 23 and 24 may be positioned perpendicular to its respective pin array and may be spaced approximately 6 mm away from its pin array charging tip end, in some embodiments. The spacing between the screen grids 23 and 24 and the surface of the photoreceptor 12 may be approximately 1.5 to 2.0 mm, in some embodiments. Each of the grids 23 and 24 are electrically isolated from the other so that an independent DC voltage from 23A and 24A can be applied to each. The angle of the charging pin arrays 21 and 22 relative to the surface of the photoreceptor 12 and the angle of the two screen grids 23 and 24 relative to the surface of the photoreceptor 12 allows for an overall system width smaller than normal in the conventional two pin array charging devices.

Side shields 25 and 26 of the charging device 20 may be positioned on either side of the two pin arrays. In some embodiments, the side shields 25 and 26 may be spaced approximately 18 mm from each other with the two pin arrays 21 and 22 centered therebetween. Each of the side shields 25 and 26 may be electrically connected to its closest grid.

Owing to the compactness of the corona charging system, toner contamination collects on the inner surfaces 25A, 26A of the side shields 25 and 26. The build up of toner contamination causes an insulating layer to be formed on the side shields 25 and 26 which adversely effects the field formation between the tips of the pin arrays 21 and 22 (or wires) and the side shields 25 and 26. That is, the resulting insulating layer reduces the electric field between the tips of the pin arrays 21 and 22 (or wires) and the side shields 25 and 26. The reduction of the electric field reduces the amount of ion generation at the tips the pin arrays 21 and 22 and causes the voltage of the photoreceptor 12 to become non-uniform. The non-uniformity yields poor halftone uniformity on document prints.

Figure 2:
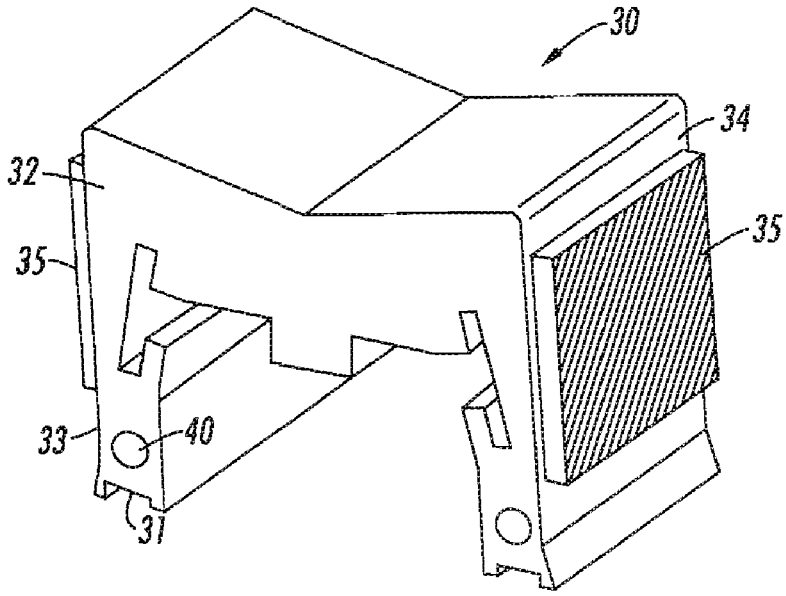
FIG. 2 is an inverted perspective view of an exemplary cleaning apparatus.

FIG. 2 is a perspective inverted representation of one corona charging device cleaning apparatus 30. The apparatus 30 may be used to clean a corotron, scorotron or any other corona charging device that is used in printers, copiers, fax machines or other image forming devices. In this exemplary embodiment, the apparatus 30 is relatively compact so as to clean a compact corona charging device. A compact corona charging device may be one that charges a photoreceptor having a diameter, for example, of 60 mm or less. In this exemplary embodiment, the apparatus may have a width of about 18 mm or less in order to movably fit between the side shields 25 and 26 of the charging device 20. However, in other embodiments, the dimensions of the apparatus 30 may be larger in order to clean a relatively larger corona charging device that charges a photoreceptor having a diameter greater than 60mm. That is, the cleaning apparatus 30 and method are not limited to use with compact charging devices that charge small diameter photoreceptors.

The corona charging device cleaning apparatus 30 includes a support member 32. The support member 32 may be comprised of a metal, a plastic, or a composite material. The support member 32 is not limited to any particular shape, except that the shape preferably is compatible to fit within and clean components of the charging device 20. The support member 32 includes two side surfaces 33 and 34. The side surfaces 33 and 34 face in opposite directions from each other, such that each side surface 33 and 34 faces a corresponding inner surface 25A, 26A of the side shields 25 and 26 of the charging device 20. The side surfaces 33 and 34 may be planar or non-planar. The configuration (orientation, shape, etc.) of the side surfaces 33 and 34 may match the inner surfaces 25A, 26A of the side shields 25 and 26.

A side shield cleaning member 35 is attached to each side surface 33 and 34. The side shield cleaning member 35 cleans an inner surface 25A, 26A of the side shields 25 and 26 of the charging device 20 when the cleaning apparatus 30 is moved relative to the charging device 20. Each side shield cleaning member 35 may be disposed within the boundary of its side surface 33 or 34, or may extend beyond the side surfaces 33 and 34. The side shield cleaning member 35 may include an abrasive material that scrubs the inner surfaces 25A, 26A of the side shields 25 and 26 (when the cleaning apparatus is moved relative to the charging device 20) to remove toner or silica contamination that collects on the inner surface of the side shields 25 and 26 as a result of the charging operation of the charging device 20. The build up of toner contamination causes an insulating layer to be formed on the side shields 25 and 26, which reduces the electric field between the charging-components of the charging device 20 and the side shields 25 and 26. When used regularly to clean the charging device 20, the side shield cleaning member 35 prevents the contaminating insulating layer from being formed, and thus maintains superior electric field formation and good uniformity over the life of the charging device 20.

Each side shield cleaning member 35 may be comprised of one or a combination of foam, felt, sandpaper, nylon, metal fibers, stiff plastic fibers, and a brush. Additionally, each side shield cleaning member 35 may be replaceable. That is, if the side shield cleaning member 35 becomes worn, or otherwise is in need of repair, it may be detached from the support member 32 and replaced with a new or refurbished side shield cleaning member 35. Thus, if the support member 32 has a longer usable life than the side shield cleaning member 35, the support member 32 would not need to be replaced when the side shield cleaning member 35 is no longer effective due to regular use over the period of its normal life. This embodiment saves costs associated with providing a new support member 32 when the side shield cleaning member 35 is in need of repair or replacement.

The corona charging device cleaning apparatus 30 may include a guide 40 connected to an end portion 31 of the support member 32 to guide movement of the apparatus 30 along the length of the charging device 20. The guide 40 may include an aperture through the end portion 31 of the support member 32. The aperture may slidably accommodate therein a dowel, track or rail along which the apparatus 30 moves during a cleaning operation. In another embodiment, the guide 40 may include a slot or groove. Further, the guide 40 may be connected to a portion of the support member 32 other than the end portion 31.

Figure 3:
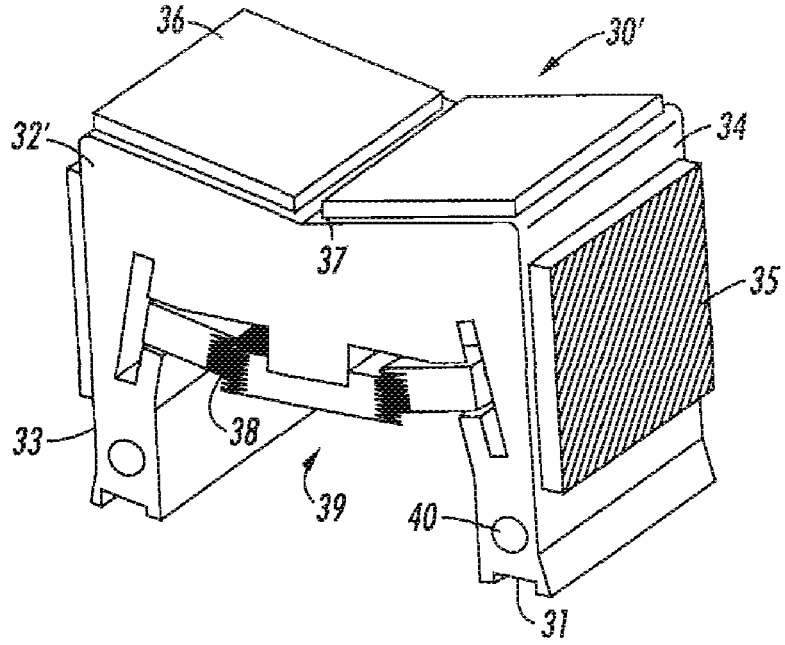
FIG. 3 is an inverted perspective view of an exemplary alternative cleaning apparatus.

FIG. 3 is an inverted schematic view of an alternative cleaning apparatus 30'. The apparatus 30' may include all of the features and alternatives of the cleaning apparatus 30 illustrated and discussed with respect to FIG. 2. In the alternative embodiment, the support member 32' further includes a concavity 37 extending between the side surfaces 33 and 34. A screen grid cleaning member 36 is attached to the concavity 37 so as to clean a screen grid 23, 24 of the charging device 20. Thus, the cleaning apparatus 30' of this embodiment additionally cleans the screen grids 23, 24 during the cleaning operation of the side shields 25 and 26.

The support member 32' also includes a cavity portion 39 between the side surfaces 33 and 34. Charging-component cleaning members 38 are disposed inside the cavity portion 39 so as to clean the charging components (such as wires or the pin arrays 21 and 22) of the charging device 20. The charging-component cleaning member 38 includes a plurality of bristles. Thus, the cleaning apparatus 30' of this preferred embodiment cleans all at once the inner surface of each side shield 25 and 26, the screen grids 23 and 24, and the charging component (21 and 22) of the charging device 20 during the cleaning operation of the side shields 25 and 26, during one cleaning operation.

As an alternative, the charging component cleaning members 38 can be provided in combination with the side shield cleaning members 35, but without providing the grid cleaning members 36 on the support 32'.

In preferred embodiments, the side shield cleaning member 35 is more abrasive (that is, it is rougher and/or harder) than the screen grid cleaning member 36 and/or the charging-component cleaning member 38.

In each of the alternative embodiments, the side shield cleaning member 35 may be made of one or a combination of foam, felt, sandpaper, nylon, metal fibers, stiff plastic fibers, and a brush. Additionally, the side shield cleaning member 35 may be replaceable. Further, the corona charging device cleaning apparatus 30' in each of the alternative embodiments may include the guide 40 described with respect to the embodiment of FIG. 2.

Figure 4:
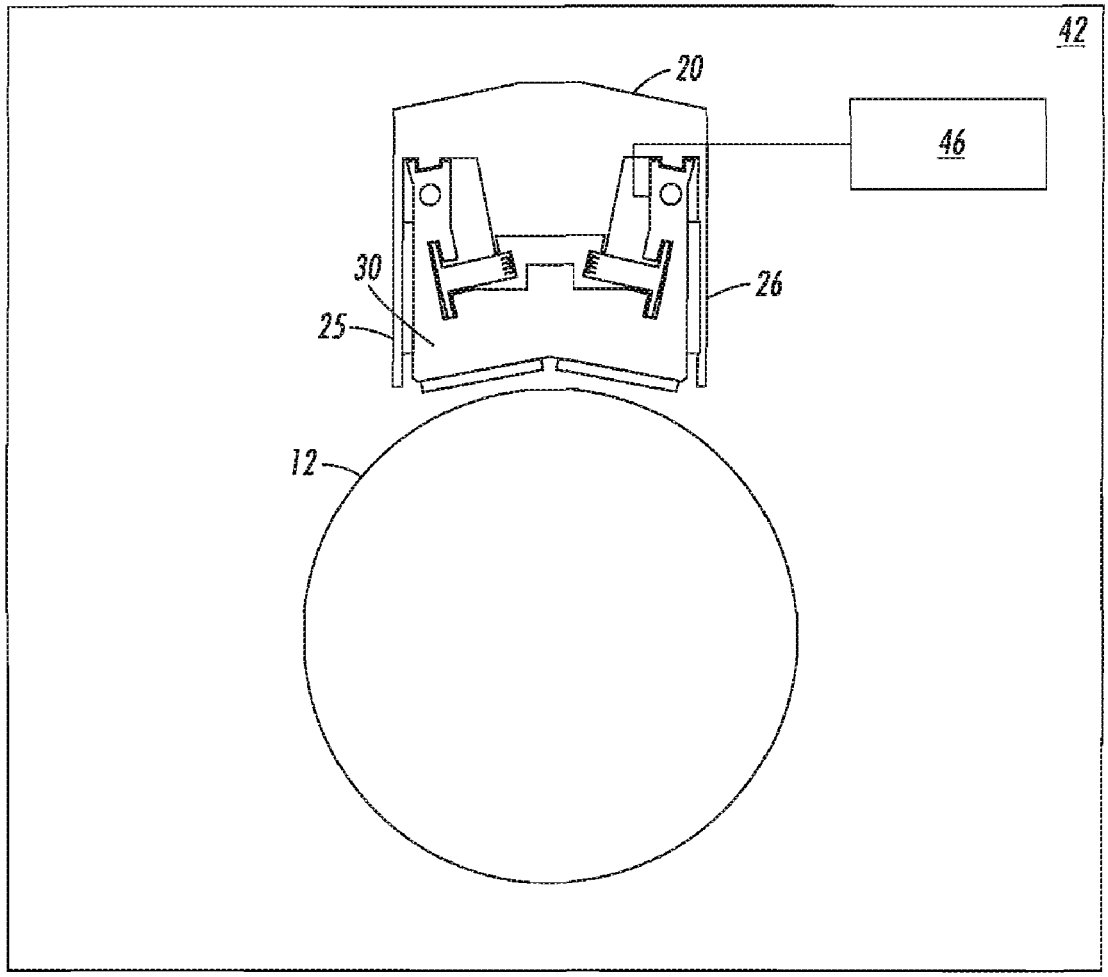
FIG. 4 schematically illustrates a configuration of a xerographic device including an exemplary cleaning apparatus.

FIG. 4 illustrates a configuration of xerographic device 42 having an exemplary corona charging device cleaning apparatus 30, the charging device 20, the photoreceptor 1-2, and an actuator 46. In the xerographic device 42 of this embodiment, the charging device 20 is disposed above the photoreceptor 12 at a predetermined distance, for example at a distance of approximately 1.5 to 2.0 mm. The cleaning apparatus 30 is disposed within the xerographic device 42 so that it can be moved into and then within the charging device 20 so as to be movable substantially along the length of the charging device 20 during a cleaning operation. The apparatus 30 is operatively connected to the actuator 46. The actuator 46 moves the apparatus 30 along substantially an entire length of the charging device 20 during a cleaning operation. The actuator 46 can be, for example, a motor and lead screw configuration. The operation, connection and control of the actuator 46 with the apparatus 30 may be accomplished by appropriate operation and connection of conventional control systems. In an exemplary system, a lead screw is placed through a threaded hole in support member 32 of the cleaning apparatus 30. A motor, mounted inside the xerographic machine is mechanically coupled to one end of the lead screw. The motor is actuated in one direction to rotate the lead screw to traverse the cleaning apparatus 30 along the length of the charging device 20. A sensing mechanism is used to sense when the cleaning apparatus 30 has reached the end of the charging device 20, after which the motor is reversed to return the cleaning apparatus 30 to its original, pre-cleaning position. The apparatus 30 may be removable from within the charging device 20 for maintenance or replacement of a cleaning member of the apparatus 30. After cleaning, the cleaning apparatus 30 preferably is moved to a position where it is outside of the imageable area of the photoreceptor 12 so that the cleaning apparatus 30 does not interrupt the imaging process. As an alternative to movably mounting the cleaning apparatus 30 within the xerographice device 42, the cleaning apparatus 30 can be a standalone device used, for example by a technician to manually clean the charging device 20.

Figure 5:
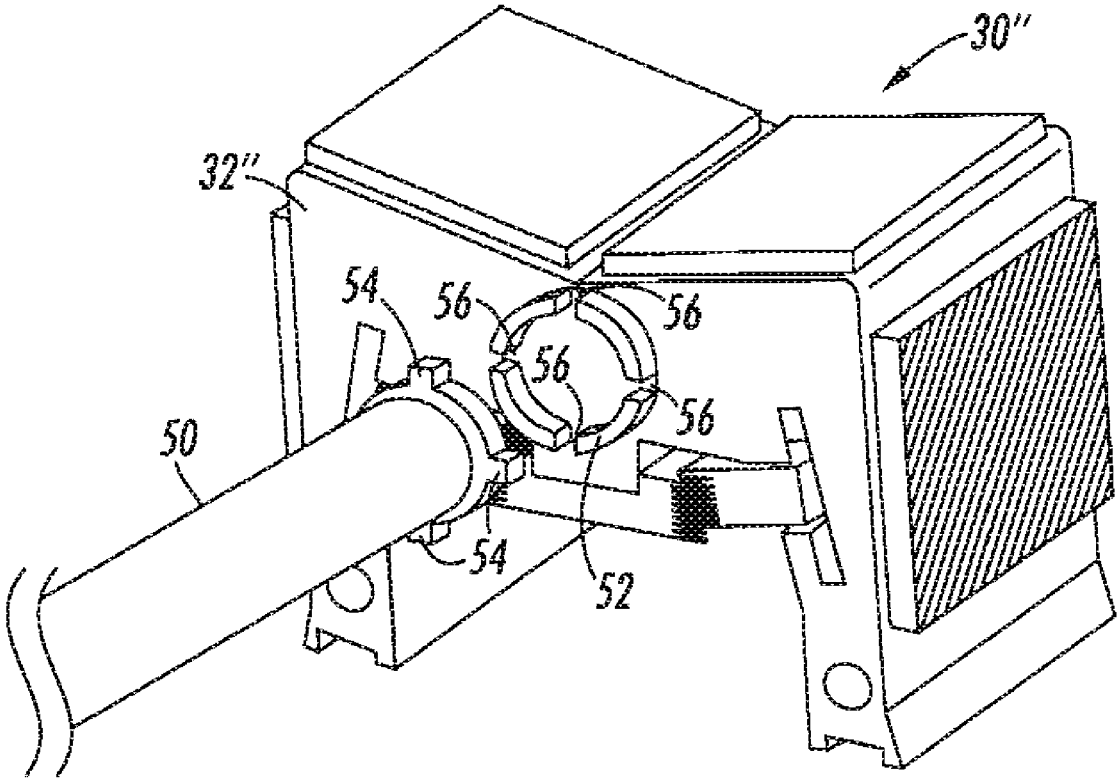
FIG. 5 is a perspective view of an exemplary cleaning apparatus with a rod that is detachably connected to the cleaning apparatus.

FIG. 5 illustrates an exemplary cleaning apparatus 30" with a rod 50 that is detachably connected to the cleaning apparatus 30". In this embodiment, the support member 32" of the apparatus 30" includes a connection portion 52 on a surface substantially perpendicular to the direction of movement of the apparatus during a cleaning operation. The connection portion 52 includes insertion openings 56 disposed along a hollow perimeter thereof. The rod 50 may have a plurality of protruding teeth 54 at a first end thereof. To detachably connect the rod 50 to the apparatus 30", the teeth 54 of the rod 50 are inserted into the insertion openings 56 and the rod 50 is rotated along its longitudinal axis to rotate the teeth 54 to a locking position within the hollow perimeter of the connection portion 52. To disconnect the rod 50 from the apparatus 30", the rod is rotated along its longitudinal axis in a direction opposite the direction for insertion, until the teeth 54 are able to be withdrawn from the insertion openings 56. Alternatively, the connection of the rod 50 and the apparatus 30" may be accomplished by other conventional connection systems (for example, threads).

When attached to the support member 32" of the apparatus 30", the rod 50 may be used to manually move the cleaning apparatus 30" substantially along a length of the charging device 20. The rod 50 may be comprised of a metal, a plastic, or a composite material. The rod 50 may be attached to an embodiment of the apparatus 30" in which the apparatus 30" has already been installed in the xerographic device 42.

In practice, the charging device 20 is cleaned by providing the side shield cleaning member 35 that cleans an inner surface 25A, 26A of the side shields 25 and 26 of the charging device 20, and moving the side shield cleaning member 35 substantially along a length of the charging device 20 to remove particles from the inner surface 25A, 26A of each side shield 25 and 26. Optionally, at least one of the screen grid cleaning member 36 and the charging-component cleaning member 38 may be provided to additionally clean the screen grids 23 and 24 and the charging component (such as 21 and 22) of the charging device 20. In each of the above options, the alternative embodiments of the apparatus 30, the actuator 46 and/or the rod 50, as discussed above, may be incorporated.

While the invention has been described in conjunction with exemplary embodiments, these embodiments should be viewed as illustrative, and not limiting. It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art and are also intended to be encompassed.

What is claimed is:

1. A corona charging device cleaning apparatus comprising:

a support member including two side surfaces that face in opposite directions;

a side shield cleaning member attached to each side surface to clean an inner surface of a side shield of a corona charging device;

a screen grid cleaning member attached to a surface of a concavity of the support member to clean a screen grid of the corona charging device; and a charging-component cleaning member disposed inside a cavity portion of the support member to clean a charging component of the corona charging device, wherein the side shield cleaning member includes an abrasive material that is more abrasive than the screen grid cleaning member and the charging-component cleaning member.

2. The apparatus of claim 1, wherein the side shield cleaning member is at least one of foam, felt, sandpaper, nylon, metal fibers, stiff plastic fibers and a brush.

3. The apparatus claim 1, wherein the charging-component cleaning member is comprised of bristles.

4. The apparatus of claim 1, wherein the side shield cleaning member is replaceably attachable to the support member.

5. A xerographic device comprising the apparatus of claim 1.

6. The xerographic device of claim 5, further comprising:

a corona charging device; and an actuator that is operatively connected to the corona charging device cleaning apparatus, wherein the actuator moves the cleaning apparatus substantially along a length of the corona charging device during a cleaning operation.

7. The xerographic device of claim 6, further comprising:

guide means connected to an end portion of the support member to guide an advancement of the cleaning apparatus along the length of the corona charging device.

8. The apparatus of claim 1, wherein the apparatus is detachably connected to a rod so as to be manually movable substantially along a length of the corona charging device.

9. A method of cleaning a corona charging device, the method comprising:

providing a side shield cleaning member attached to two oppositely-facing side surfaces of a support member to clean an inner surface of a side shield of the corona charging device, a screen grid cleaning member attached to a surface of a concavity of the support member to clean a screen grid of the corona charging device, and a charging-component cleaning member disposed inside a cavity portion of the support member to clean a charging component of the corona charging device, wherein the side shield cleaning member includes an abrasive material that is more abrasive that the screen grid cleaning member and the charging-component cleaning member; and moving the side shield cleaning member substantially along a length of the corona charging device to remove particles from the inner surface of the side shield.

10. The method of claim 9, wherein the side shield cleaning member is at least one of foam, felt, sandpaper, nylon, metal fibers, stiff plastic fibers and a brush.

11. A corona charging device cleaning apparatus comprising:

a support member including two side surfaces that face in opposite directions away from each other, a concavity, and a cavity portion;

a side shield cleaning member attached to the side surfaces to clean an inner surface of a side shield of a corona charging device;

a screen grid cleaning member attached to the concavity of the support member to clean a screen grid of the corona charging device; and a charging-component cleaning member disposed inside the cavity portion of the support member to clean a charging component of the corona charging device, wherein the side shield cleaning member includes an abrasive material that is more abrasive than the screen grid cleaning member and the charging-component cleaning member.

12. The apparatus of claim 11, wherein the side shield cleaning member is at least one of foam, felt, sandpaper, nylon, metal fibers, stiff plastic fibers and a brush.

* * * * *